United States Patent [19]

Ueda et al.

[11] Patent Number: 4,774,505

[45] Date of Patent: Sep. 27, 1988

[54] METHOD AND APPARATUS FOR RECOGNIZING A GRIPPED CONDITION OF LINENS

[75] Inventors: Atsushi Ueda; Hidetoshi Ishihara; Kunio Kojima, all of Nagoya, Japan

[73] Assignees: Mitsubishi Jukogyo Kabushiki Kaisha; Churyo Engineering Kabushiki Kaisha, both of Japan

[21] Appl. No.: 52,433

[22] Filed: May 21, 1987

[30] Foreign Application Priority Data

Dec. 15, 1986 [JP] Japan ..... 61-298451

[51] Int. Cl.[4] ..... G08B 21/00

[52] U.S. Cl. ..... 340/674; 38/7; 38/143; 198/464.3; 340/540

[58] Field of Search ..... 340/540, 674; 38/7, 38/143; 198/464.3, 465.4, 502.1

[56] References Cited

U.S. PATENT DOCUMENTS

| | | | |
|---|---|---|---|
| 3,092,263 | 6/1963 | Beaudry et al. | 214/1 |
| 3,092,271 | 6/1963 | Beaudry et al. | 214/152 |
| 4,143,476 | 3/1979 | Holmes et al. | 38/7 |
| 4,150,374 | 4/1979 | Brook | 340/674 |
| 4,313,269 | 2/1982 | van Rumpt et al. | 38/143 |
| 4,501,529 | 2/1985 | Wiebesick | 38/143 |

FOREIGN PATENT DOCUMENTS 2336510 7/1977 France .

*Primary Examiner*—Glen R. Swann, III

*Attorney, Agent, or Firm*—Bernard, Rothwell & Brown

[57] ABSTRACT

In a conveyor for continuously conveying linens or like materials one by one as gripped at a plurality of points by chucks moving along a rail, a first sensor for detecting passage of the chuck is disposed at a predetermined position along the rail, and two or more second sensors for detecting existence of a linen are disposed at two or more predetermined positions. Means is provided for expanding a distance between adjacent chucks being moved continuously in the proximity of the first sensor. In response to detection signals issued from the sensors, the condition of the chucks gripping the linens can be recognized whether a given chuck is gripping a front corner, a rear corner or a middle point on an upper edge of a linen, it is gripping only one point of a linen, or it is gripping nothing (that is, idle).

2 Claims, 8 Drawing Sheets

FIG. 19
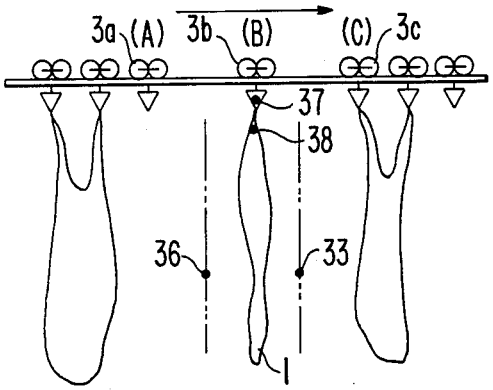
FIG. 20
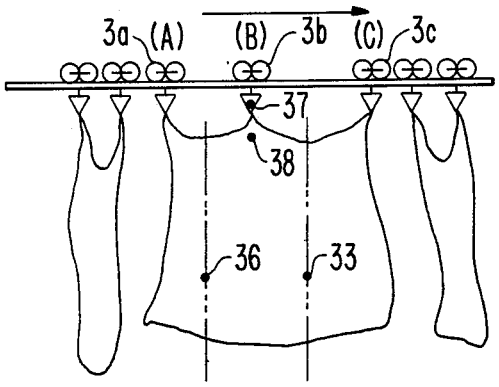
FIG. 21
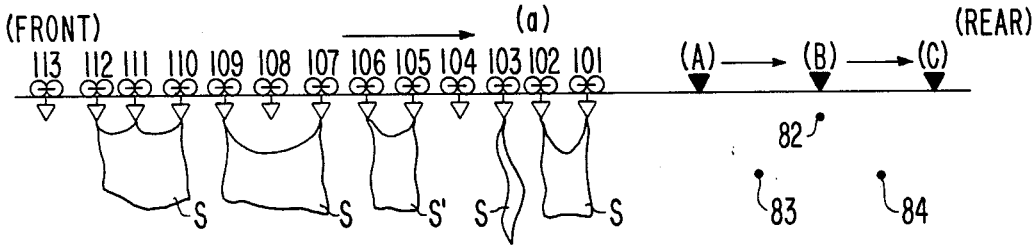
FIG. 22
| CHUCK NO. | 101 | 102 | 103 | 104 | 105 | 106 | 107 | 108 | 109 | 110 | 111 | 112 | 113 |
|---|---|---|---|---|---|---|---|---|---|---|---|---|---|
| SENSOR 82 | ○ | ○ | ○ | × | ○ | ○ | ○ | × | ○ | ○ | ○ | ○ | × |
| SENSOR 83 | ○ | × | × | × | ○ | × | ○ | ○ | × | ○ | ○ | × | × |
FIG. 23
| CHUCK NO. | 101 | 102 | 103 | 104 | 105 | 106 | 107 | 108 | 109 | 110 | 111 | 112 | 113 |
|---|---|---|---|---|---|---|---|---|---|---|---|---|---|
| SENSOR 82 | ○ | ○ | ○ | × | ○ | ○ | ○ | × | ○ | ○ | ○ | ○ | × |
| SENSOR 84 | × | ○ | × | × | × | ○ | × | ○ | ○ | × | ○ | ○ | × |
FIG. 24
| | 101 | 102 | 103 | 104 | 105 | 106 | 107 | 108 | 109 | 110 | 111 | 112 | 113 |
|---|---|---|---|---|---|---|---|---|---|---|---|---|---|
| SENSOR 82 | ○ | ○ | ○ | × | ○ | ○ | ○ | × | ○ | ○ | ○ | ○ | × |
| SENSOR 83 | ○ | × | × | × | ○ | × | ○ | ○ | × | ○ | ○ | × | × |
| SENSOR 84 | × | ○ | × | × | × | ○ | × | ○ | ○ | × | ○ | ○ | × |

METHOD AND APPARATUS FOR RECOGNIZING A GRIPPED CONDITION OF LINENS

BACKGROUND OF THE INVENTION

1. Field of the Invention:

The present invention relates to a method and an apparatus for recognizing a gripped condition of linens which can be utilized with a hanging type conveyor for conveying linens in a laundry factory, a conveyor for conveying soft products having indefinite shapes such as cloth or film being hung at a plurality of points thereof, or the like.

2. Description of the Prior Art:

Heretofore various types of, conveyors for conveying linens (bed sheets, towels, 'yukata's, etc.) one by one in a laundry factory have been known. By way of example, in a spreader-feeder which is a human-labor-saving machine used after an operator has spread out a bed sheet after washing and dewatering before he throws it into a roll-ironer, a hanging type conveyor is shown for conveying bed sheets after an operator has made moving chucks grip two adjacent corners of a bed sheet (Japanese Patent Publication No. 58-22240).

Now explaining this prior art with reference to FIGS. 31 through 34, in these figures reference numeral 1 designates linens, and illustration is made for the case of bed sheets as representative ones of linens. These linens 1 are spread out by an operator after washing and dewatering, and they are conveyed with their two adjacent corners gripped by chucks 2. The chuck 2 includes a twist spring 23 therein, and a linen 1 is held as pinched between a frame 21 and a lever 22. A bearing 20 is provided at a head portion of the chuck so that the chuck can move freely within a rail 11. Reference numeral 25 designates a weight which is provided for the purpose of balance adjustment. Reference numeral 10 designates the so-called "spreader-feeder" which is an automatic linen spreading and conveying apparatus in which the chucks 2 pinching two corners of the linen 1 and being fed along the rail 11 are separated from each other. Then the chucks 2 are opened under the state where they have spread out the linen 1, and only the linen 1 is conveyed to a roll-ironer by means of a belt conveyor. The chucks 2 after releasing the linens 1 are automatically recovered in this apparatus and discharged along a rail 12.

Reference numeral 11 designates a feed rail for conveying the chucks 2 pinching a linen 1 to the spreader-feeder 10, and if the rail 11 inclines in the forward direction of the gravity, then the chucks 2 would move due to their own gravity. Or else, in the case where the rail 11 is disposed as directed in the direction against the gravity or in the horizontal direction, the chucks 2 are moved as pushed by brackets 15 mounted to a chain 16 circulating in a drive rail 13. A recovering rail 12 serves to convey idle chucks 2 which have released the linen 1, and has the same structure as the feed rail 11. Drive rails 13 and 14 have guides 17 made of resin assembled therein so that the chain 16 may circulate through the guides 17. Brackets 15 made of resin are mounted to the chain 16 at a predetermined distance to push and move the chucks 2 in the feed rail 11 and the recovering rail 12. Also, the chain 16 is circulated by making use of a sprocket 18 or the like. Furthermore, the chain 16 has gap spaces between its rollers and pins so that it can be flexed in the vertical and horizontal directions.

Now description will be made of the operations in the above-described apparatus in the prior art. An operator makes the chucks respectively grip adjacent two corners of linens at an input station to feed them sequentially along the feed rail 11. The linens 1 are conveyed to the spreader-feeder 10 as suspended from the chucks 2 moving along the feed rail 11, by the action of the drive rail or, if the feed rail inclines, by the action of the gravity. During this period, with regard to the chucks 2, for one linen (bed sheet) always two chucks gripping the adjacent corners of the linen must align along the rail 11 in regular sequence. And, in the spreader-feeder 10, the linen 1 is spread out by intaking the chucks 2 two by two as conveyed along the feed rail and separating them horizontally in a sequential manner. Thereafter, the linen 1 is released from the chucks 2, and is transferred onto a belt-conveyor to be conveyed to a roll-ironer. Also, the chucks 2 are collected on a single rail within the spreader-feeder 10, and fed to the recovering rail 12 to be conveyed to the inlet station similar to the linen feeding step.

In the case where linens are transported continuously in a suspended condition with each linen gripped by gripping members such as chucks at a plurality of points, in order to separate the linens one by one or to spread them out, it must be automatically and momentarily recognized which ones of the chucks gripping the linens are gripping a same linen. For instance, in the case of spreading out linens (bed sheets) in the prior art as described above, it is a basic principle that always chucks gripping two adjacent corners of a linen align two by two for conveying the linens, and in the event that one idle chuck not gripping a linen 1, that is, not pertinent to the conveying should mix with the series of chuck pairs, or in the event that one of the chucks 2 gripping the adjacent two corners of the linen should have released the linen, then a problem would arise that the spreader-feeder 10 cannot achieve its normal operation.

Because of the above-mentioned reasons, it is the present situation that always an operator must watch the gripping condition between the chucks 2 on the feed rail 11 and the linens 1. In other words, if it can be automatically and momentarily recognized in the midway of transportion of linens whether or not two chucks 2 being conveyed successively surely grip two adjacent corners of a linen 1, then it becomes possible to reject only the faulty chucks in front of the spreader-feeder 10.

SUMMARY OF THE INVENTION

It is therefore one object of the present invention to provide a method and an apparatus for automatically and momentarily recognizing a gripped condition of linens in a conveying system for conveying linens or like materials as gripped by chucks moving along a rail at a plurality of points along an upper edge of each linen.

According to one feature of the present invention, there is provided a method for recognizing a gripped condition of linens in a conveyor for continuously conveying linens while the linens are gripped and kept hanging at a plurality of points by chucks moving along a rail, consisting of the steps of expanding distances between the chucks being transported continuously, and detecting, by means of sensors, passage of the chucks as well as existence of a linen at two or more predetermined positions with the linen kept spread out, whereby chucks gripping a same linen can be recognized.

According to another feature of the present invention, there is provided an apparatus for recognizing a gripped condition of linens, comprising a conveyor for continuously conveying said linens while hanging said linens with chucks moving along a rail, means for expanding distances between said chucks, sensors for detecting passage of said chucks as well as existence of a linen at two or more predetermined positions, and control means for processing detection signals issued from said sensors, whereby chucks gripping a same linen can be recognized.

According to the present invention, intervals between conveying chucks of hanging type which are transported continuously are temporarily expanded, passage of a chuck, existence of a linen just under the same chuck, and existence of a linen at a position in the proximity of the center of the expanded chuck interval are detected by means of sensors such as photo-electric sensors, limit switches, etc., and by logically processing the results of detection it can be momentarily determined whether or not two successive chucks grip a same linen. Therefore, if a linen is gripped by only one chuck, or a chuck grips nothing, that is, is idle, then such faulty chuck can be momentarily recognized and hence they can be rejected before coming into the above-described spreader-feeder 10.

The above-mentioned and other objects, features and advantages of the present invention will become more apparent by reference to the following description of preferred embodiments of the invention taken in conjunction with the accompanying drawings.

BRIEF DESCRIPTION OF THE DRAWINGS

In the accompanying drawings:

FIGS. 17 to 20 show different gripped conditions of linens and arrangement of sensors for explaining a method for recognizing a gripped condition of linens according to a third preferred embodiment of the present invention;

FIG. 21 shows one example of a gripped condition of linens and arrangement of three linen sensors;

FIG. 22 is a table showing results of detection of two linen sensors with respect to the respective chucks and gripped conditions of the respective linens which can be deduced from the results of detection;

FIG. 23 is a table showing results of detection of two different linen sensors with respect to the respective chucks and gripped conditions of the respective linens which can be deduced from the results of detection;

FIG. 24 is a table showing results of detection of all the three linen sensors with respect to the respective chucks and gripped conditions of the respective linens which can be deduced from the results of detection;

DESCRIPTION OF THE PREFERRED EMBODIMENTS

Figure 1:
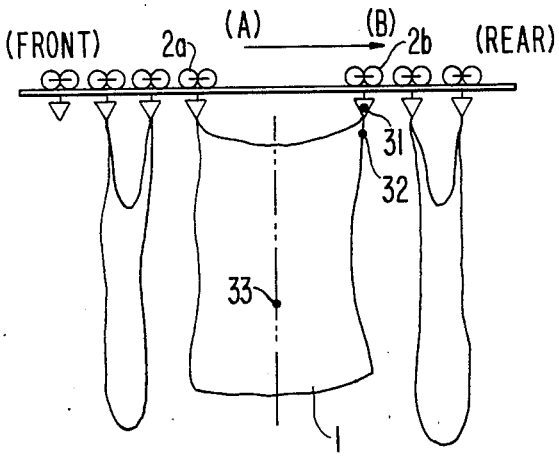
FIGS. 1 to 8 show different gripped conditions of linens and arrangement of sensors for explaining a method for recognizing a gripped condition of linens according to a first preferred embodiment of the present invention.
Figure 2:
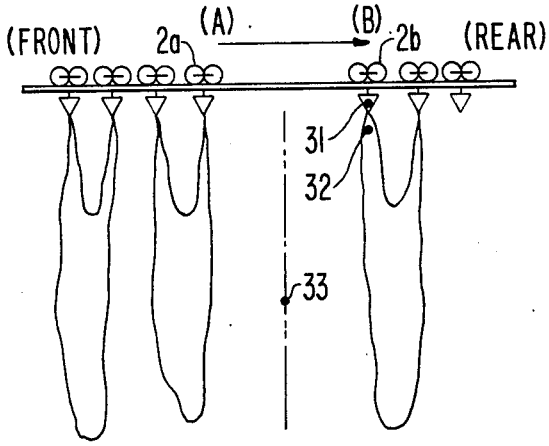

Now description will be made of the preferred embodiments of the present invention. First, a basic principle for recognizing a gripped condition of linens on the basis of detection signals issued from a chuck sensor and linen sensors according to the present invention will be explained with reference to FIGS. 1 to 8 which illustrate a first preferred embodiment of the present invention.

In these figures, reference numeral 1 designates linens, numeral **2*a* designates a front chuck when a linen 1 has been spread out, numeral 2*b* designates a rear chuck when a linen 1 has been spread out, numeral 31 designates a chuck sensor (rear), numeral 32 designates a linen sensor for detecting existence of a linen just under the chuck sensor 31, and numeral 33** designates another linen sensor for detecting existence of a linen in the proximity of the center of the expanded chuck interval.

Figure 7:
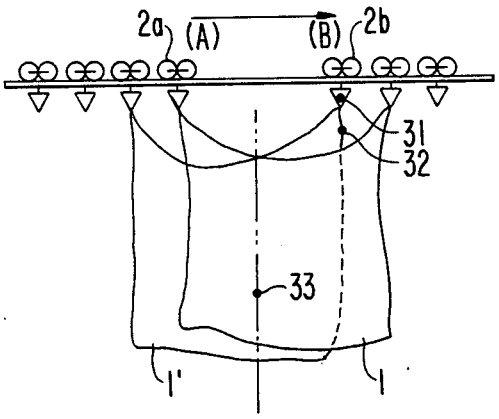

Before explaining the method for recognition, it is assumed that chucks are transported always one by one successively from the left side in FIG. 1, and that it would never occur that between chucks gripping a same linen 1, a chuck gripping another linen is present as shown in FIG. 7.

Figure 4:
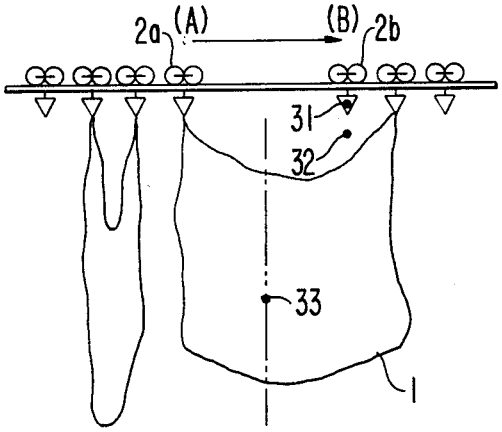
Figure 8:
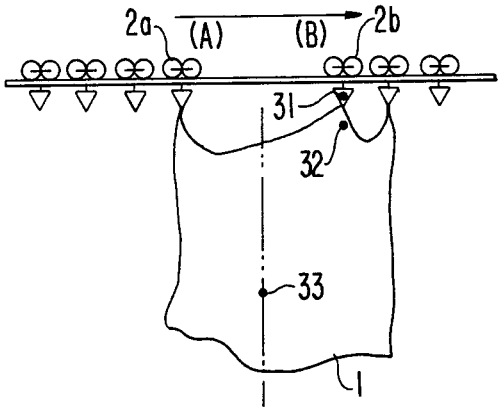

In the case where when the sensor 31 detects that a chuck **2*b* has come to a position (B) the sensors 32 and 33 simultaneously detect existence of a linen, the gripped condition of linens is only the condition shown in FIG. 1 or FIG. 8, and it means that in front of the chuck 2*b* including a position (A) always there exists a chuck gripping the same linen as that gripped by the chuck 2*b*. Among the chucks transported successively thereafter, such chuck that when it has come to the position (B) the sensor 33 cannot detect a linen but the sensor 32 can confirm existence of a linen, is found to be the chuck gripping the same linen (See FIG. 2). During this period, there may occur the condition as shown in FIG. 4, but under such condition, since the sensor 32 can not detect a linen because the chuck 2*b* in FIG. 4 does not grip the linen and hence the linen is sagging, it is seen that this chuck 2*b* is irrelevant to gripping of the linen 1**.

Figure 3:
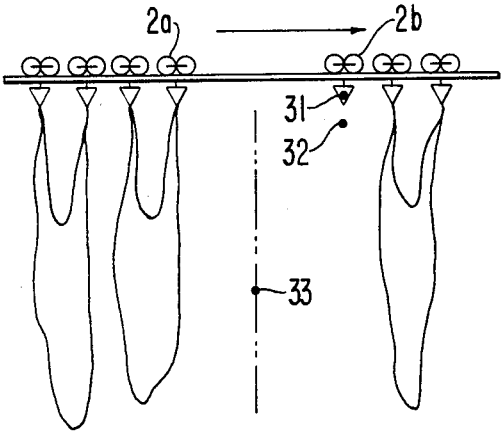
Figure 5:
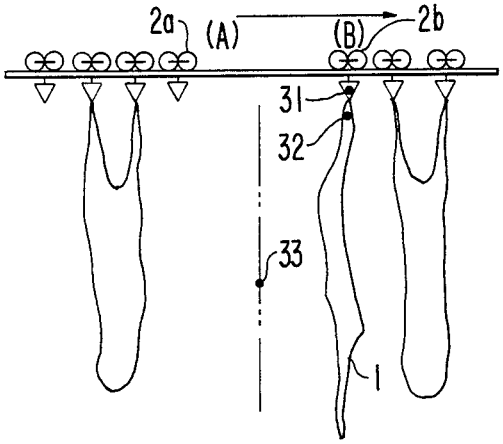
Figure 6:
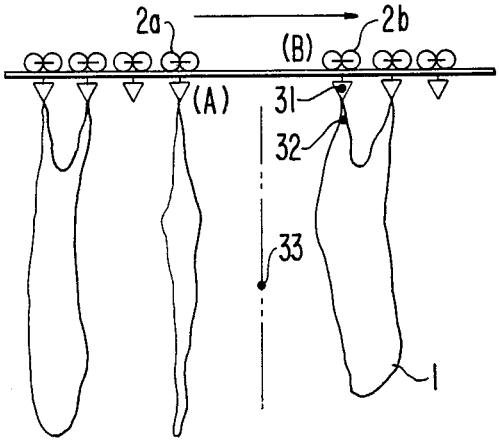

When the chuck **2*b* is gripping nothing at the position (B), naturally the sensor 32 and 33 cannot detect a linen (See FIG. 3). In the case where a linen gripped by a chuck only at one point has come to the position (B) as shown in FIG. 5, only the sensor 32 can detect a linen, and also since the sensor 33 must have not detected a linen when the just preceding chuck came to the position (B), this condition would never be confused with the condition shown in FIG. 6. It is to be noted that while the sensor 33 is depicted as a dot for the sake of convenience, ideally a linen should be detected at every point represented by a double-dot chain line. This is because the sagging of the linen is not definite depending upon its size and the expanded chuck interval. However, if the object linen is limited to fixed size and shape and if the expanded chuck interval is constant, the linen could be detected at one point as shown in FIGS. 1 through 8**.

Next, a method of recognizing a gripped condition of linens according to a second preferred embodiment of the present invention, in which a front side chuck gripping a linen as well as existence of a linen just under the chuck and in the proximity of the center of the expanded chuck interval are detected to recognize a same linen, will be explained with reference to FIGS. 9 to 16. In these figures, reference numeral 34 designates a chuck sensor (front), numeral 35 designates a linen sensor for detecting existence of a linen just under the chuck sensor 34, and numeral 36 designates a linen sensor for detecting existence of a linen in the proximity of the center of the expanded chuck interval.

Figure 13:
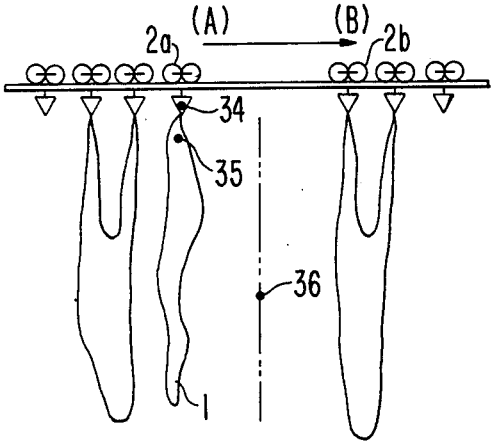
Figure 14:
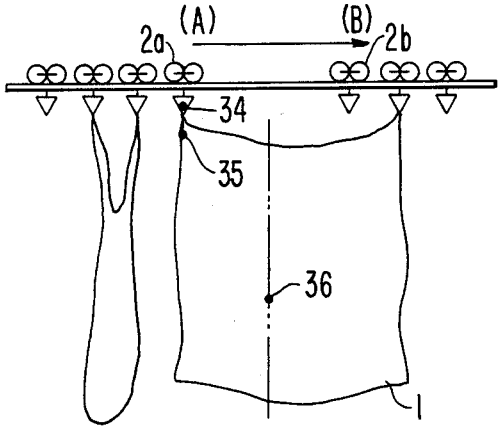
Figure 15:
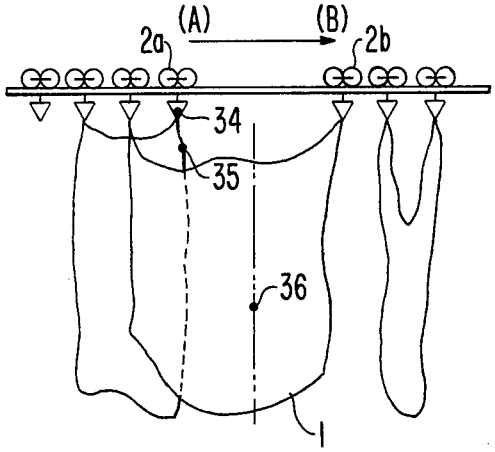

It is assumed that chucks are transported always one by one successively from the left side in FIGS. 9 to 16, and that it would never occur that between chucks gripping a same linen, a chuck gripping another linen is present as shown in FIG. 15.

Figure 9:
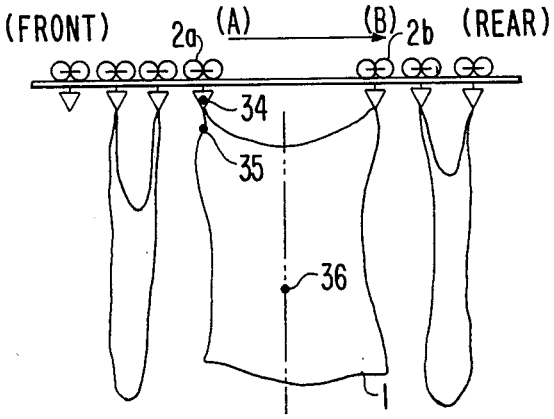
FIGS. 9 to 16 show different gripped conditions of linens and arrangement of sensors for explaining a method for recognizing a gripped condition of linens according to a second preferred embodiment of the present invention.
Figure 10:
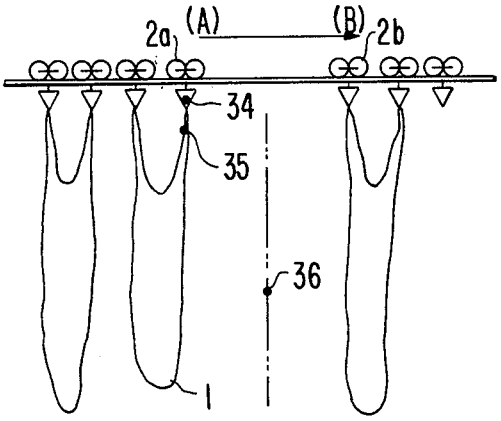
Figure 11:
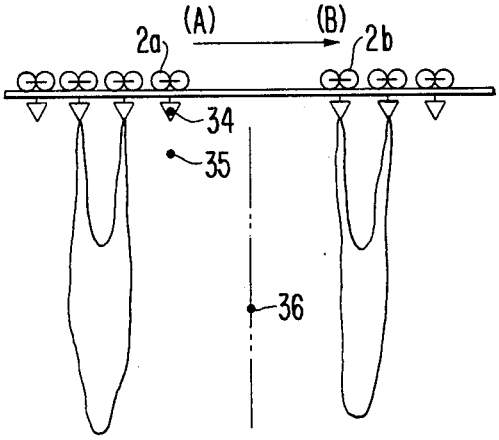
Figure 12:
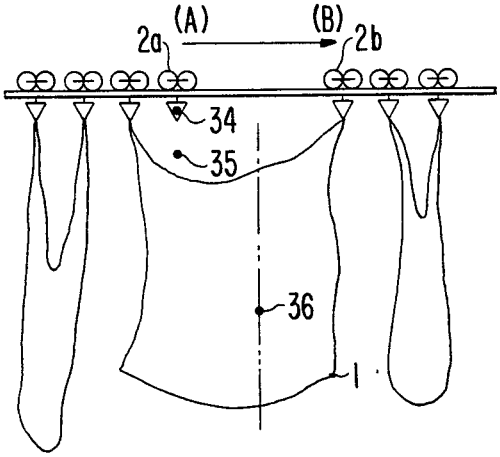
Figure 16:
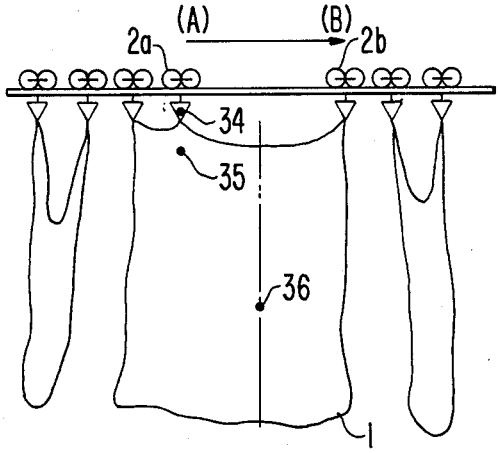

In the case where when the sensor 34 detects that a chuck 2*a* has come to a position (A) the sensors 35 and 36 simultaneously detect existence of a linen, the gripped condition of linens is only the condition shown in FIG. 9, 14 or 16, and it means that behind the chuck 2*a* including a position (B) always there exists a chuck gripping the same linen as that gripped by the chuck 2*a*.

Thereafter, when a certain succeeding chuck has come to the position (A), if the sensor 36 cannot detect a linen at that moment, it is found that the preceding chuck which is located at the position (B) at that moment is gripping the last transported linen. The case where the last chuck gripping a same linen can be recognized is such case that when a given chuck has come to the position (A), the sensor 35 can detect a linen but the sensor 36 cannot detect a linen, and moreover when the same chuck has come to the position (B) the sensor 36 can detect a linen (See FIGS. 10 and 13). When a chuck 2*a* exists at the position (A) (as detected by the sensor 34), if the sensor 35 does not detect a linen, it is seen that this chuck 2*a* is not gripping a linen (See FIG. 12). In the case where a chuck is gripping a linen only at one point as shown in FIG. 13, this condition can be recognized by the fact that when the same chuck 2*a* has come to the position of the chuck 2*b*, the sensor 36 does not detect a linen.

It is to be noted that while the sensor 36 is depicted as a dot for the sake of convenience, ideally a linen should be detected at every point represented by a double-dot chain line. This is because the sagging of the linen is not definite depending upon its size and the expanded chuck interval. However, if the object linen is limited to fixed size and shape and if the expanded chuck interval is constant, the linen could be detected at one point as shown in FIGS. 9 through 16.

Recognition of the chuck gripping the the last position in the direction of traveling of a linen gripped at a plurality of positions by chucks, according to the methods described above with reference to FIGS. 1 through 16 must be determined by processing the respective data sensed by the sensors 31, 32, 33, 34, 35 and 36, respectively, jointly with the data sensed by the respective sensors when the just preceding chucks were located at the same predetermined positions in the course of movement of the chucks and stored in a memory. Alternatively, if the sensors shown in FIGS. 1 through 16 are combined as shown in FIGS. 17 through 20, and if such mechanism that linens can be conveyed as gripped by chucks under the condition that the chuck intervals are always expanded in the two sections (A)–(B) and (B)–(C) on the conveyor is assured by means of a drive conveyor or the like, then even without storing the data sensed by the respective sensors in a memory as described above, it can be immediately recognized whether or not a linen gripped by a given chuck is the same linen as that gripped by the preceding or succeeding chuck.

Now the last-mentioned method for recognization will be described with reference to FIGS. 17, 18, 19 and 20. In these figures, reference numeral 37 designates a chuck sensor, numeral 38 designates a linen sensor disposed just under the chuck sensor 37 for detecting existence of a linen. It is assumed that chucks are always conveyed one by one successively from the left side in FIG. 17, and that similar to the methods illustrated in FIGS. 1 through 16, it would never occur that between chucks gripping a same linen a chuck gripping another linen is present.

Figure 17:
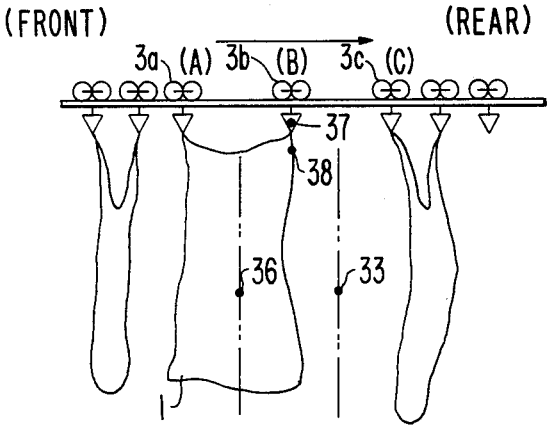
Figure 18:
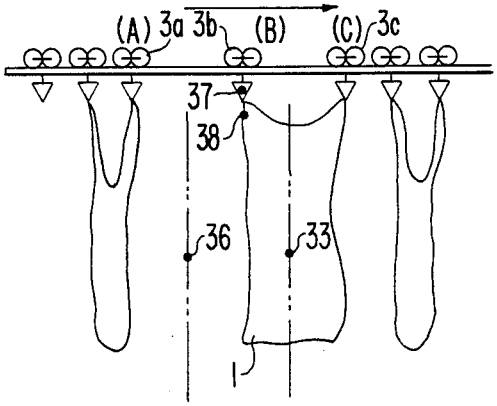

When the sensor 37 detects that a chuck 3*b* has come to a position (B) and the sensor 38 confirms that the same chuck 3*b* is gripping a linen, if the sensor 33 does not detect a linen and the sensor 36 detects a linen, then it is seen that the chuck 3*b* is the first chuck in the direction of traveling of linens among chucks gripping the same linen (See FIG. 17). Or else, at this moment if the sensor 33 detects a linen and the sensor 36 does not detect a linen, then it is seen that the chuck 3*b* is the last chuck in the direction of traveling of linens among chuck gripping the same linen (See FIG. 18). Furthermore, if all the sensors 33, 36 and 38 detect a linen, then it can be recognized that chucks gripping the same linen as that gripped by the chuck 3*b* exist in front of and behind the chuck 3*b* (See FIG. 20).

In addition, when the sensor 37 detects that the chuck 3*b* has come to the position (B), if the sensor 38 cannot detect a linen, then it is seen that the chuck 3*b* is gripping no linen. If the sensor 37 detects that the chuck 3*b* has come to the position (B), at that moment the sensor 38 confirms existence of a linen, but the sensors 33 and 36 do not detect a linen, then it is meant that the gripping condition of the chuck 3*b* is the condition shown in FIG. 19.

Now description will be made of FIGS. 21 through 24. Here it is assumed that a plurality of linens S are successively transported in the direction of arrows along a same rail as suspended by chucks 101–113. Also it is assumed that the chucks 101–113 are transported sequentially through positions (A)→(B)→(C) with their interval expanded automatically at a predetermined distance. It is to be noted that reference numeral 82 to 84 designate sensors, which are photo-electric sensor or limit switches for detecting the linens S.

At first, a method for recognizing the same linen by detecting the rear chuck as well as existence of the linen just under the rear chuck and the linen at the center of the pitch of the expanded chuck intervals, will be explained with reference to FIGS. 21 and 22. FIG. 22 shows signals issued from the sensors 82 and 83 with respect to each case where any arbitrary chuck has come to the position (B). It is to be noted that in FIGS. 21 through 24 mark ◯ represents a signal in the case where existence of a linen S has been confirmed, while mark X represents a signal in the case where it cannot be confirmed. First, in the case where the chuck 101 has come to the position (B), both the sensors 82 and 83 issue signals indicating existence of a linen, meaning that there exists a chuck gripping the same linen in front of the chuck 101. When the chuck 102 has come to the position (B), the sensor 83 cannot detect a linen, and hence it is seen that the chucks 101 and 102 are gripping the same linen.

Subsequently, when the chuck 103 has come to the position (B), it is known by the sensor 82 that the chuck 103 is gripping a linen, but the sensor 83 cannot detect a linen, also it is obvious from the above description that the chuck 102 is gripping another linen, and therefore, it is known that the chuck 103 is under such condition that only one corner of the linen is gripped by the chuck 103. With regard to the chuck 104 neither the sensor 82 nor the sensor 83 can detect a linen, and so, it is known that this chuck is in an idle condition. Also, in the case of the chucks 105 and 106, the conditions are similar to those in the case of the chucks 101 and 102, respectively, and it is known that they are gripping the same linen. In the case of the chuck 107, since both the sensor 82 and the sensor 83 confirm existence of a linen, it is known that there exists a chuck gripping the same linen in front of the chuck 107.

However, when the chuck 108 has come to the position (B), the sensor 82 cannot detect the sagging linen, and so, it is known that this chuck 108 is not gripping a linen. Next, with respect to the chuck 109, it is sensed by the sensor 82 that this chuck 109 is gripping a linen, but it is also sensed by the sensor 83 that in front of the chuck 109 there is no chuck gripping the same linen, and therefore, it is known that the same linen is gripped by the chucks 107 and 109. In the case of the chuck 110, similarly to the case of the chuck 107 it is known that in front of the chuck 110 there exists another chuck gripping the same linen. However, in the case of the chuck 111, since both the sensors 82 and 83 confirm existence of a linen in distinction from the case of the chuck 109 or the chuck 110, it is known that the chuck 111 is gripping the same linen as the chuck 110 and in front of the chuck 111 there exists another chuck gripping the same linen. When the chuck 112 has come to the position (B), since the sensor 83 cannot detect a linen, it can be concluded that the chucks 110, 111 and 112 are gripping the same linen. With regard to the chuck 113, the condition is similar to that in the case of the chuck 104.

Next, a method for recognizing the same linen by detecting a front chuck as well as existence of the linen just under the front chuck and the linen at the center of the distance of the expanded chuck intervals, will be explained with reference to FIGS. 21 and 23. Referring now to FIG. 23, when the chuck 101 has come to the position (B), since the sensor 82 confirms existence of a linen but the sensor 84 cannot confirm it, it is known that the chuck 101 is the most preceding chuck among chucks gripping the same linen. In the case of the chuck 102, since both the sensors 82 and 84 detect a linen, it is known that this chuck 102 is gripping the same linen as the chuck 101. When the chuck 103 has come to the position (B), since the sensor 84 does not detect a linen but the sensor 82 detects a linen, it is known that this chuck 103 is gripping a linen that is different from the linen gripped by the chucks 101 and 102. When the chuck 104 has come to the position (B), due to the fact that neither the sensor 82 nor the sensor 84 detects a linen, it is known that the chuck 103 was gripping only one corner of a linen and the chuck 104 is gripping nothing. In a similar manner to the case of the chucks 101 and 102, it is known that the chucks 105 and 106 are gripping the same linen.

Further, when the chuck 107 has come to the position (B), it is known that this chuck 107 is gripping a different chuck from that gripped by the preceding linen because the sensor 82 detects a linen and the sensor 84 does not detect it. With regard to the chuck 108, since the sensor 82 does not detect a linen, it is known that this chuck 108 is gripping nothing, and since the sensor 84 detects a linen it is also known that another chuck in front of the chuck 108 is gripping the same linen as that gripped by the chuck 107. When the chuck 109 has come to the position (B), since both the sensors 82 and 84 detect a linen, it is known at this time point that this chuck 109 is gripping the same linen as the chuck 107. Next, when the chuck 110 has come to the position (B), in a similar manner to the case of the chucks 101, 103, 105 and 107, it is known that this chuck 110 is gripping another linen. Subsequently, in the case of the chucks 111 and 112, since both the sensors 82 and 84 detect a linen, it is known that they are gripping the same linen as that gripped by the chuck 110. Finally, when the chuck 113 has come to the position (B), it is found that this chuck 113 is gripping nothing, from the same reason as described above in connection to the chuck 104.

Now, a method for recognizing the same linen by detecting existence or non-existence of a linen just under a chuck and at positions in front of and behind the position of the chuck, will be explained with reference to FIGS. 21 and 24. Although it was necessary to store in a memory the information of existence or non-existence of a linen at the respective sensor positions when each chuck has come to the position (B) in regular sequence according to the method illustrated in FIG. 22 or 23, in the method shown in FIG. 24 at the time point when each chuck has come to the position (B) the gripped condition of a linen can be known immediately by means of the sensors 82, 83 and 84. It is to be noted that combinations of the detection signals issued from the sensors 82, 83 and 84 logically comprises eight ($2^3=8$) patterns as will be described below.

---

(1) None of the sensors 82, 83 and 84 detects a linen. Then the chuck located at the position (B) is not gripping a linen, nor is there a linen which is gripped by chucks in front of and behind the position (B).

(2) Only the sensor 84 detects a linen.
(3) Only the sensor 83 detects a linen.
Such condition would not occur practically.

(4) Only the sensors 83 and 84 detect a linen. Then, there are chucks gripping the same linen in front of and behind the position (B) so as to straddle the chuck at the position (B). Naturally, the chuck located at the position (B) is not gripping that linen.

(5) All the sensors 82, 83 and 84 detect a linen. This case is similar to the case (4) above, except for that the chuck located at the position (B) is gripping the same linen as the chucks in front of and behind the position (B).

(6) Only the sensors 82 and 84 detect a linen. Then, it is known that another chuck gripping -continued

| | |
|---|---|
| | the same linen exists behind the position (B) and the chuck located at the position (B) is a chuck gripping the last corner of the linen. |
| (7) | Only the sensors 82 and 83 detect a linen. Then, it is known that another chuck gripping the same linen exists in front of the position (B) and the chuck located at the position (B) is a chuck gripping the first corner of the linen. |
| (8) | Only the sensor 82 detects a linen. In this case it is known that the chuck located at the position (B) is gripping a linen only at its one corner. |

Figure 25:
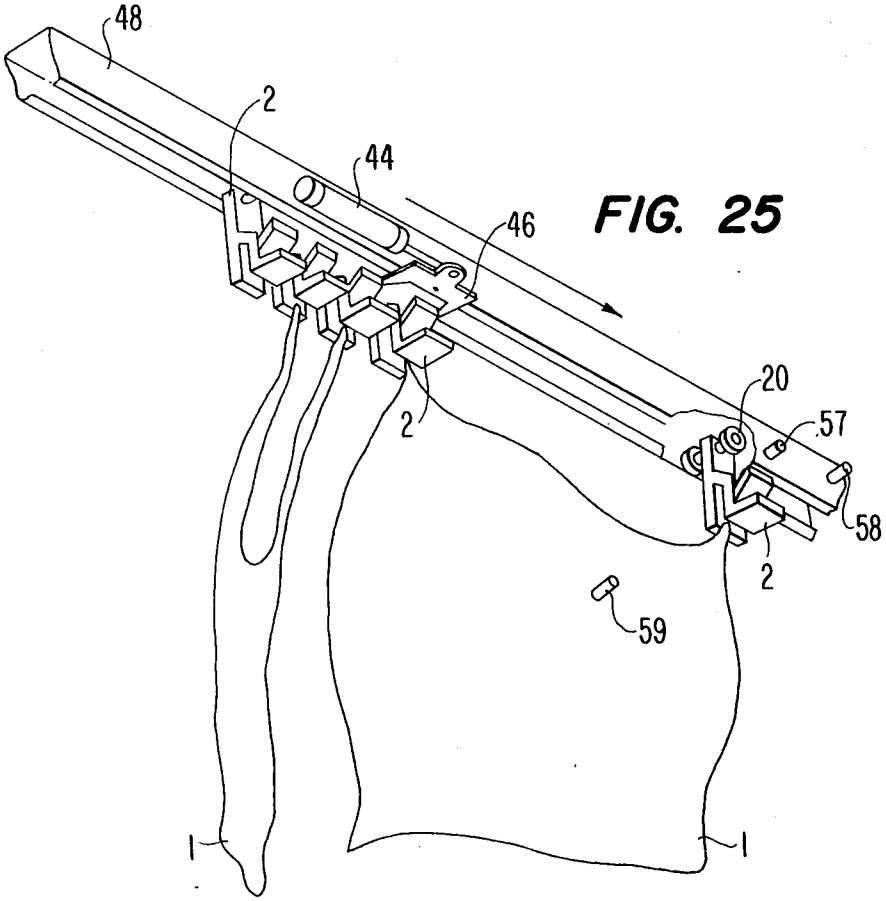
FIG. 25 is a perspective view of a device for expanding an interval between chucks in the preferred embodiments of the present invention.

Now an apparatus according to one preferred embodiment of the present invention will be explained with reference to FIGS. 25 to 30. FIG. 25 shows one preferred embodiment of a device for spreading out a linen 1 according to the present invention. In this figure, reference numeral 20 designates bearing rollers, and numeral 48 designates a rail, within which the bearing rollers 20 of the chucks 2 can move. It is to be noted that the rail 48 shown in FIG. 5 is inclined so the chucks 2 are conveyed in the direction of the arrow by their own weight via gravity. Reference numeral 57 designates a sensor which detects existence of a chuck, and for this sensor, a photo-sensor, an approach sensor, a limit switch, etc. can be employed. Reference numeral 58 designates another sensor which detects existence of a linen just under the chuck 2, and for this sensor, a photo-sensor, a limit switch, an ultra-sonic sensor, etc. can be employed. Reference numeral 59 designates still another sensor for detecting existence of a linen, and for this sensor, a photo-sensor, an ultra-sonic sensor, etc. can be employed. Reference numeral 46 designates a stopper, details of which are shown in FIGS. 26 and 27, and this stopper 46 operates so as to feed the chucks 2 one by one each time an air cylinder 44 makes one reciprocation.

Figure 27:
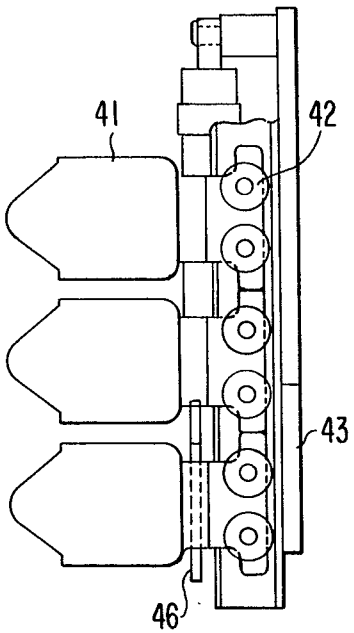
FIG. 27 is a side view of the same as viewed in the direction of arrow A in FIG. 26.
Figure 26:
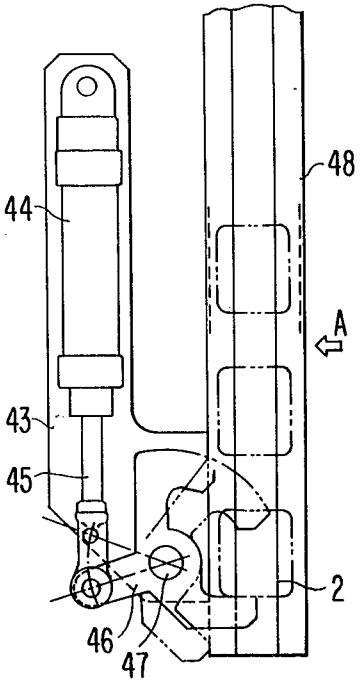
FIG. 26 is a plan view of the same chuck interval expanding device.

Referring now to FIGS. 26 and 27, reference numeral 44 designates an air cylinder which causes the stopper 46 to make reciprocating rotary motion about a shaft 47. If a cylinder shaft 45 contracts starting from the state shown in FIG. 26, then the stopper 46 moves to the position indicated by double-dot chain lines and one chuck 2 is delivered. Reference numeral 43 designates a base plate for supporting the rail 48, the cylinder 44 and the shaft 47.

Now description will be made of an operation of the preferred embodiment shown in FIGS. 25, 26 and 27. Chucks 2 gripping linens 1 and moving along the rail 48 due to their own weight, would stop in the midway of the rail as supported by the stopper 46. Thereafter, for every one reciprocation of the stopper 46, the chucks 2 are released one by one from the stopper 46 and would move due to their own weight. Subsequently, when the released chuck 2 has come to the position of the sensor 57, the sensors 58 and 59 detect either existence or non-existence of a linen, and these detection signals are picked up and sent to a central control unit as will be described in the following.

Figure 30:
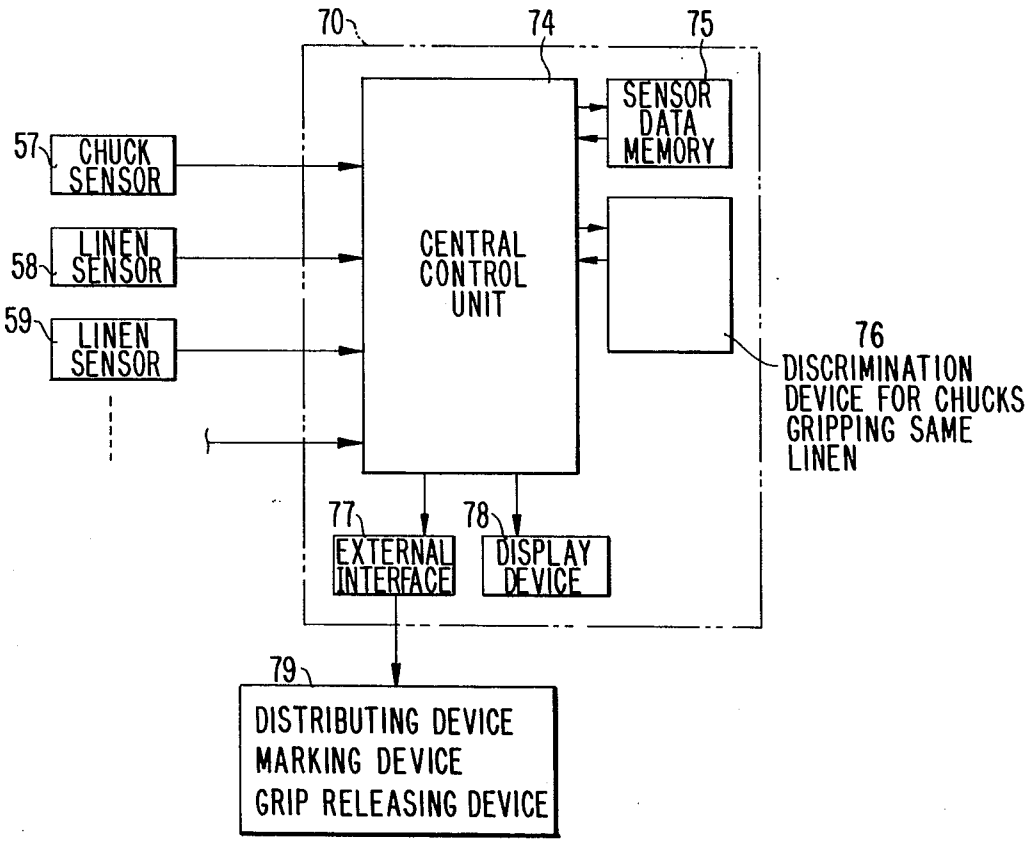
FIG. 30 is a block diagram of a control system for the same linen transporting conveyor.
Figure 32:
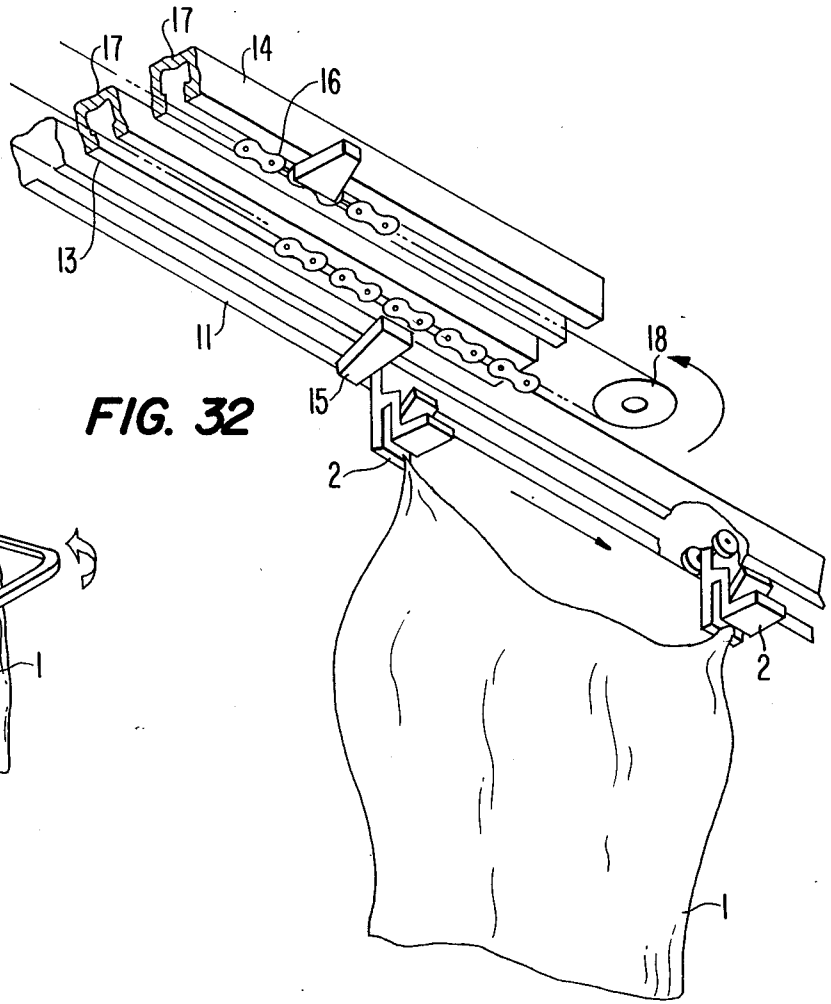
FIG. 32 is a perspective view of a chuck interval expanding device in FIG. 31.
Figure 31:
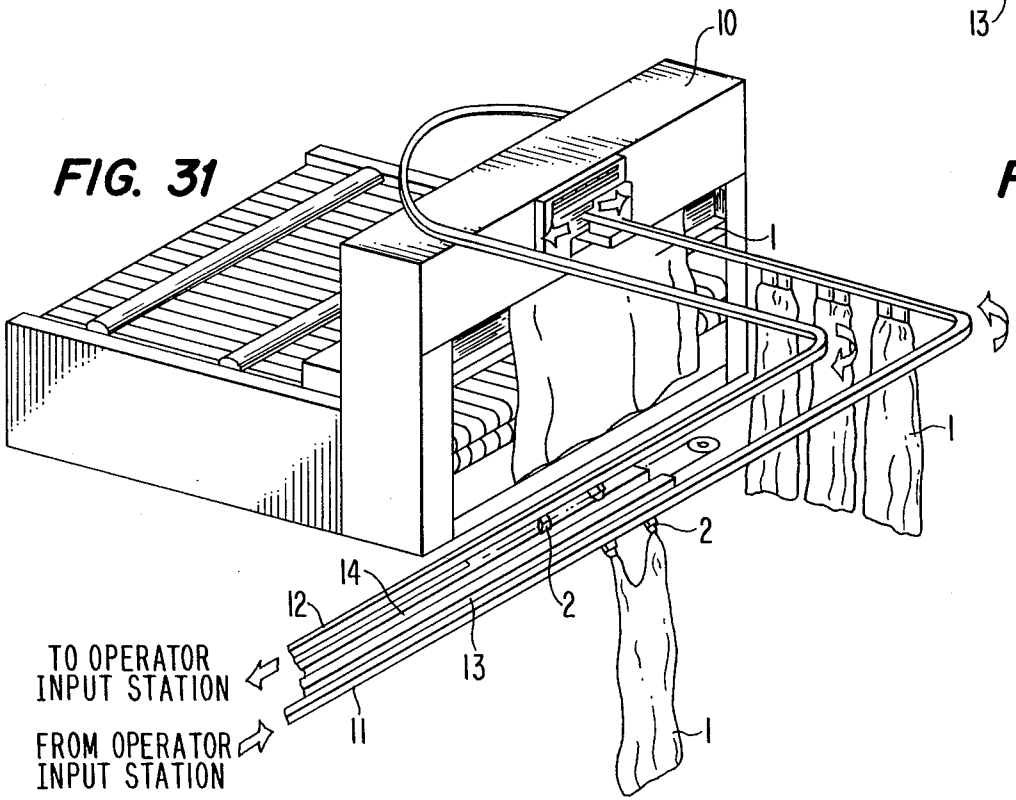
FIG. 31 is a perspective view of a linen transporting conveyor system in the prior art.
Figure 34:
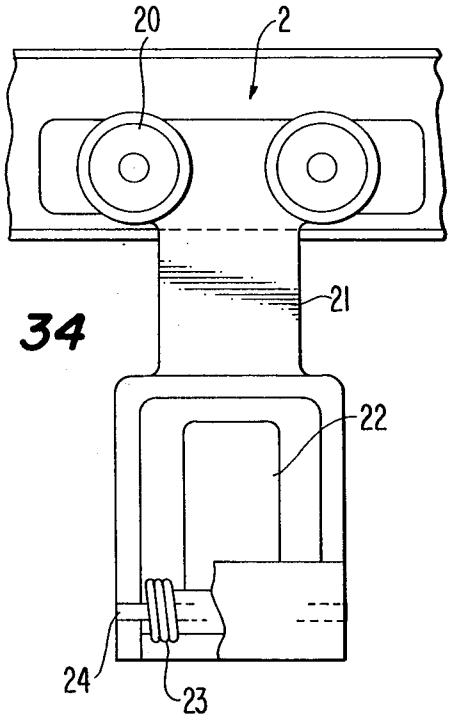
FIG. 34 is a side view of the same.
Figure 33:
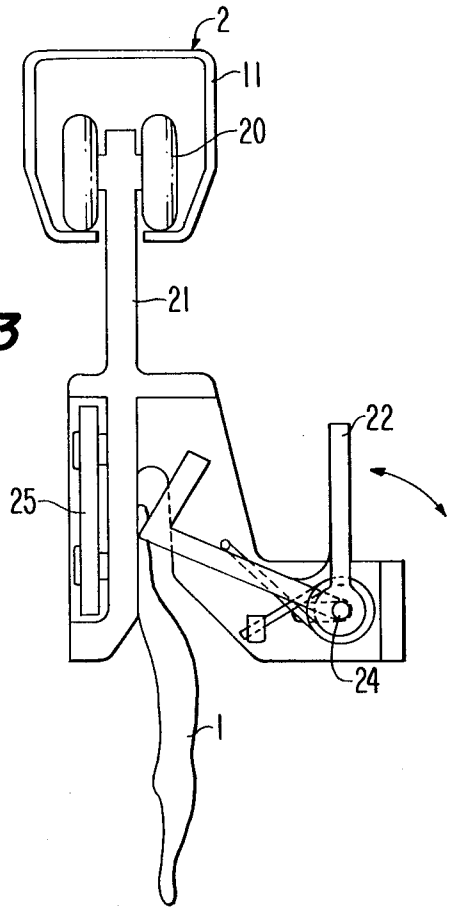
FIG. 33 is a front view of a chuck in the prior art.

Referring now to FIG. 30, the detection signals picked up from the sensors 57, 58 and 59 are input to a central control unit 74. The input sensor data are recorded in a memory device 75, and in a discrimination device 76 it is determined whether the chuck in question is gripping a same linen or not according to the above-described theory. The results of determination can be output to a display device 78, or they can achieve distribution of the chucks on a conveyor line or release of the gripped linens via an external interface 77. In addition, reference numeral 70 designates a whole control apparatus. It is to be noted that in FIG. 25 the chucks 2 should not be limited to movement caused by inclination of the rail 48 after passage of the stopper 46, and in the case where inclination is not present, they could be moved by a driving action as illustrated in FIG. 32.

Figure 28:
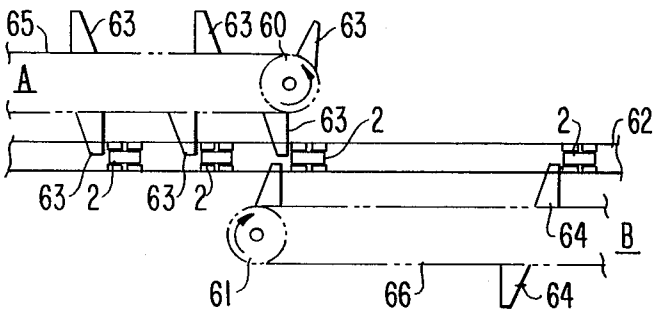
FIG. 28 is a plan view of another embodiment of a chuck interval expanding device that is different from that shown in FIG. 25.
Figure 29:
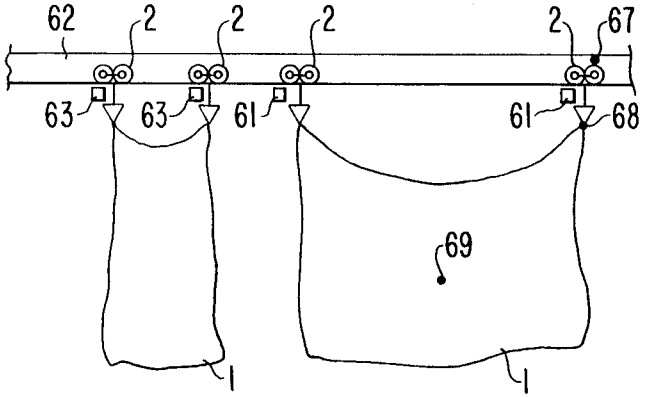
FIG. 29 is a side view of the same chuck interval expanding device in FIG. 25.

In addition, besides the method for expanding the distance between the chucks 2 in the conveyor illustrated in FIG. 25, the distance between the chucks 2 can be expanded while driving the chucks as shown in FIGS. 28 and 29. In FIGS. 28 and 29, reference numeral 67 designates a chuck sensor, numerals 68 and 69 designate linen sensors, numeral 62 designates a rail for moving chucks, numeral 60 designates a sprocket for conveyor A, numeral 61 designates a sprocket for conveyor B, numerals 65 and 66 designate drive chains for conveyors A and B, respectively, and numerals 63 and 64 designate attachments mounted to the drive chains 65 and 66, respectively, for moving the chucks 2 in synchronism with the drive chains 65 and 66.

The chucks 2 coming along the rail 62 as pushed by the attachments 63 mounted to the drive chain 65 of the conveyor A, are then conveyed by the attachments 64 mounted to the drive chain 66 of the conveyor B synchronized with the conveyor A while the distances between the chucks 2 are expanded. The conveyor B is faster in drive speed than the conveyor A, but the attachments 63 and 64 are synchronized with each other, and adjustment is made such that the chucks 2 can be delivered from the attachment 63 to the attachment 64 without any compulsive action. In FIG. 29, detection of either existence or non-existence of a linen when each chuck passes through a sensor 67 is effected by sensors 68 and 69, and the detected data are transmitted to the control unit in FIG. 30 similarly to the case of FIG. 25.

As described in detail above, according to the present invention, in a conveyor for continuously conveying suspended linens, chucks gripping a same linen can be recognized, and therefore, it becomes possible upon conveying linens to assort the linens in an unmanned manner, to detect linens under a badly gripped condition and to reject such linens. Accordingly, the present invention provides a technique that is essentially necessary for automating a hanging type conveyor for linens or similar apparatus.

While a principle of the present invention has been described above in connection to preferred embodiments of the invention, it is a matter of course that all matter contained in the above description and illustrated in the accompanying drawings shall be interpreted to be illustrative and not as a limitation to the scope of the invention.

What is claimed is:

1. A method for recognizing a gripped condition of linens being continuously conveyed along a conveyor while the linens are gripped at a plurality of points by chucks moving along a rail comprising detecting the chucks gripping the same linen by the steps of expanding the distance between the chucks being continuously conveyed and detecting by means of sensors the passage of the chucks and the existence of a linen at two or more predetermined positions while the linen is kept spread out.

2. An apparatus for recognizing a gripped condition of linens comprising a conveyor for continuously conveying the linens while hanging from chucks moving along a rail, means for expanding the distance between said chucks, sensors for detecting passage of said chucks and the existence of a linen at two or more predetermined positions, and control means for processing detecting signals issued from said sensors, whereby chucks gripping the same linen can be recognized.

* * * * *

UNITED STATES PATENT AND TRADEMARK OFFICE

CERTIFICATE OF CORRECTION

PATENT NO. : 4,774,505

DATED : SEPTEMBER 27, 1988

INVENTOR(S) : ATSUSHI UEDA, ET AL.

It is certified that error appears in the above-identified patent and that said Letters Patent is hereby corrected as shown below:

Column 1, line 15, after "Heretofore" insert -- , --;

, line 15, after "of" delete ",";

Column 2, line 8, delete "the" (third occurrence);

Column 4, line 63, delete "sensor" and substitute therefor -- sensors --;

Column 6, line 62, delete "sensor" and substitute therefor -- sensors --;

Column 10, line 66, delete "tecting" and substitute therefor -- tection --.

Signed and Sealed this

Twentieth Day of February, 1990

*Attest:*

JEFFREY M. SAMUELS

*Attesting Officer* *Acting Commissioner of Patents and Trademarks*